US010260252B2

(12) United States Patent
Boswell

(10) Patent No.: US 10,260,252 B2
(45) Date of Patent: Apr. 16, 2019

(54) BARBED STAKE

(71) Applicant: Michael D. Boswell, Daytona Beach, FL (US)

(72) Inventor: Michael D. Boswell, Daytona Beach, FL (US)

( * ) Notice: Subject to any disclaimer, the term of this patent is extended or adjusted under 35 U.S.C. 154(b) by 0 days.

(21) Appl. No.: 15/464,049

(22) Filed: Mar. 20, 2017

(65) Prior Publication Data

US 2017/0268253 A1 Sep. 21, 2017

Related U.S. Application Data

(60) Provisional application No. 62/311,084, filed on Mar. 21, 2016.

(51) Int. Cl.
*E04H 15/62* (2006.01)

(52) U.S. Cl.
CPC ..... *E04H 15/62* (2013.01)

(58) Field of Classification Search
CPC ..... E04H 15/62
USPC ..... 135/118
See application file for complete search history.

(56) References Cited

U.S. PATENT DOCUMENTS 427,815 A * 5/1890 Wolf ..... E04H 12/2215 135/118
1,100,252 A * 6/1914 O'Neill ..... F16B 15/06 411/456
1,854,671 A * 4/1932 Roberts ..... E04H 15/62 135/98
3,635,232 A * 1/1972 Rotheiser ..... E04H 15/62 135/118
5,158,258 A * 10/1992 McFadzean ..... A01G 13/0293 135/118
5,327,922 A * 7/1994 Deroche ..... E04H 15/62 135/118
5,623,843 A * 4/1997 Sands ..... B62H 3/00 248/499
5,832,672 A * 11/1998 Griffiths ..... E04H 15/62 135/115
6,349,514 B1 * 2/2002 Adams ..... A01G 9/122 135/118
9,080,587 B1 * 7/2015 Smith ..... F16B 15/02
2017/0027342 A1 * 2/2017 Mishra ..... A47G 9/062

FOREIGN PATENT DOCUMENTS

DE 3335702 A1 * 4/1985 ..... E04B 1/49
DE 29509459 U1 * 10/1995 ..... A01G 13/0293
FR 1201689 A * 1/1960 ..... E04H 15/62
FR 2869197 A1 * 10/2005 ..... A01G 13/0293

* cited by examiner

*Primary Examiner* — David R Dunn
*Assistant Examiner* — Danielle Jackson

(57) ABSTRACT

A barbed stake is an apparatus used to secure tarps, tents, and other items to the ground or to other surfaces. The barbed stake includes a stake body, a head, a stake tip, and a plurality of barbs. The head and the stake tip are positioned on opposite ends of the stake body. The head provides a large area to strike for driving the barbed stake into a surface. The head may also be used to pry the barbed stake out of a surface. The stake tip provides a pointed end to the barbed stake which helps the barbed stake to pierce a surface. Each of the plurality of barbs is laterally connected to the stake body and is aligned parallel along the stake body. In order to balance the barbed stake, each of the plurality of barbs is diametrically opposed to a corresponding barb.

5 Claims, 5 Drawing Sheets

BARBED STAKE

The current application claims a priority to the U.S. Provisional Patent application Ser. No. 62/311,084 filed on Mar. 21, 2016.

FIELD OF THE INVENTION

The present invention relates generally to stakes used for securing objects to a surface. More specifically, the present invention relates to stakes which include barbs for firmly securing tents, tarps, linings, and other objects to the ground or other surfaces.

BACKGROUND OF THE INVENTION

Tarps, tents, turf, linings, and other similar items are commonly secured to the ground or another surface with a stake or some other form of anchoring device. While many types of stakes exist today, such devices may be unreliable anchors if used incorrectly or if conditions are not ideal. Existing stakes may loosen within the surface that they are mounted in and may even become dislodged from the surface. Further, many existing products can be flimsy, making such products difficult to properly install and susceptible to breaking.

Accordingly, there is a present need for an improved stake which may provide a secure anchoring point for tarps, tents, turf, linings and similar items. Further, there is a present need for a durable stake which may hold up to a vast array of conditions. The present invention is a barbed stake which is used to secure items such as tarps and tents to a surface. The barbed stake uses a plurality of barbs which help to prevent the barbed stake from loosening within a surface or becoming dislodged from the surface. The barbed stake is made from a durable material which may hold up to hash conditions or rough use.

DETAILED DESCRIPTION OF THE INVENTION

All illustrations of the drawings are for the purpose of describing selected versions of the present invention and are not intended to limit the scope of the present invention.

Figure 1:
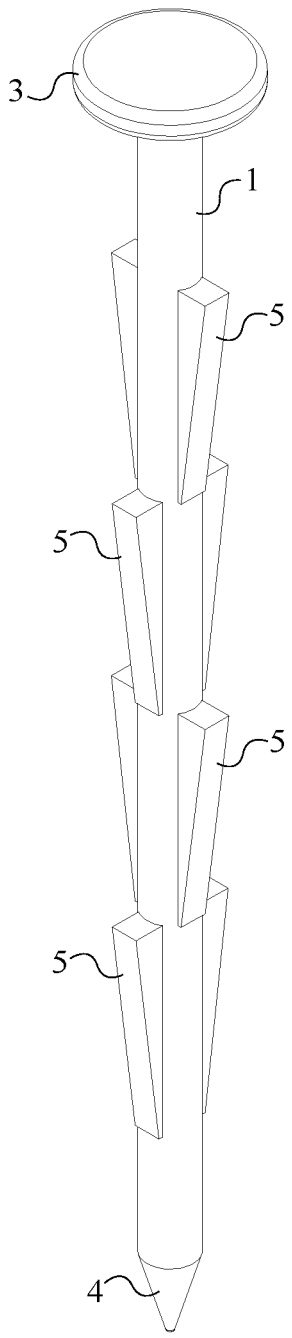
FIG. 1 is a front perspective view of the present invention.

With reference to FIG. 1, the present invention is a barbed stake which may be used to anchor tarps, tents, linings, or various other types of objects to the ground or another surface. The present invention comprises a stake body 1, a head 3, a stake tip 4, and a plurality of barbs 5. The head 3 and the stake tip 4 are concentrically connected to the stake body 1 and are positioned opposite to each other along the stake body 1. In the preferred embodiment of the present invention, the head 3 and the stake body 1 are both cylindrical in shape, with a diameter of the head 3 being greater than a diameter of the stake body 1. The head 3 provides a large area for the user to strike when driving the barbed stake into a surface. Further, the head 3 is useful when prying the barbed stake from a surface. In the preferred embodiment of the present invention, the head 3 is a discus and the stake body 1 is connected normal to the head 3. This arrangement allows the barbed stake to be driven into a surface at the same angle in which the head 3 is struck. The stake tip 4 gives the barbed stake a pointed end which helps to pierce the surface in which the barbed stake is being driven into. In the preferred embodiment of the present invention, the stake tip 4 is cylindrical-shaped with a base diameter of the stake tip 4 being equal to the diameter of the stake body 1. This provides a smooth transition between the stake tip 4 and the stake body 1.

In reference to FIG. 1, each of the plurality of barbs 5 is laterally connected to the stake body 1. The plurality of barbs 5 is used to prevent the barbed stake from loosening within the surface or becoming dislodged. Each of the plurality of barbs 5 is aligned parallel along the stake body 1. This arrangement allows the barbed stake to penetrate a surface with minimum resistance. Each of the plurality of barbs 5 is diametrically opposed to a corresponding barb, wherein the corresponding barb is from the plurality of barbs 5. This arrangement helps to give the barbed stake balance and to firmly hold the barbed stake in a surface.

Figure 2:
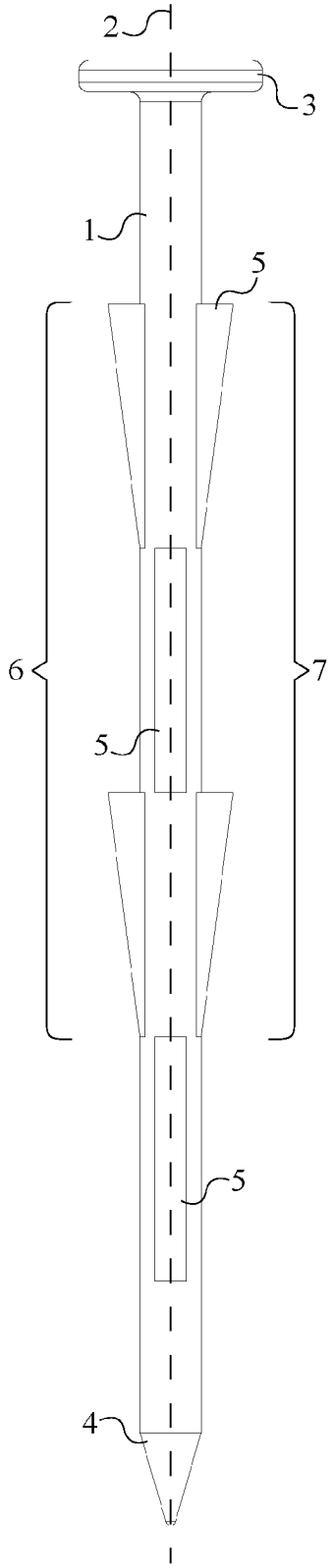
FIG. 2 is a front view of the present invention.

In reference to FIG. 2, the plurality of barbs 5 comprises a first set of barbs 6 and a second set of barbs 7. The first set of barbs 6 and the second set of barbs 7 are each linearly distributed along the stake body 1. The first set of barbs 6 and the second set of barbs 7 is diametrically opposed to each other about the stake body 1. As previously mentioned, this arrangement helps to balance the barbed stake and secure the barbed stake when driven into a surface.

Figure 3:
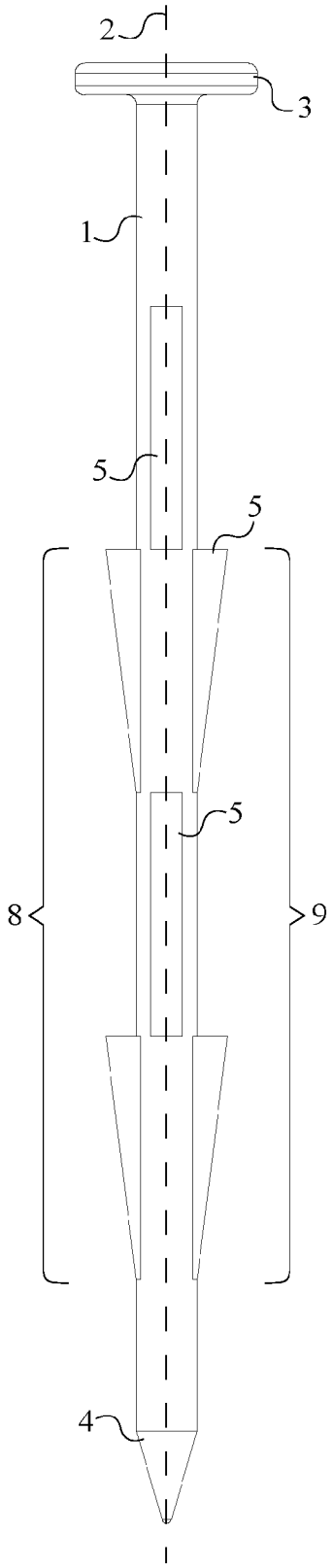
FIG. 3 is a left view of the present invention.

In reference to FIGS. 2-3, the plurality of barbs 5 further comprises a third set of barbs 8 and a fourth set of barbs 9. Like the first set of barbs 6 and the second set of barbs 7, the third set of barbs 8 and the fourth set of barbs 9 are each linearly distributed along the stake body 1. Further, the third set of barbs 8 and the fourth set of barbs 9 are diametrically opposed to each other about the stake body 1. The third set of barbs 8 is radially offset from the first set of barbs 6 by 90 degrees. This arrangement creates a crossed configuration with first set of barbs 6, the second set of barbs 7, the third set of barbs 8, and the fourth set of barbs 9. In doing so, the plurality of barbs 5 protrudes perpendicularly from the stake body 1 in four directions. This arrangement helps to maximize the stability of the barbed stake when driven into a surface.

In reference to FIGS. 2-3, in the preferred embodiment of the present invention, the third set of barbs 8 is offset from the first set of barbs 6 along the stake body 1. Similarly, the fourth set of barbs 9 is offset from the second set of barbs 7 along the stake body 1. By staggering the third set of barbs 8 and the fourth set of barbs 9 relative to the first set of barbs 6 and the second set of barbs 7, the barbed stake is able to maintain a grip within the surface along the length of the stake body 1.

In reference to FIGS. 2-3, in the preferred embodiment of the present invention, the third set of barbs 8 is offset from the first set of barbs 6 towards the stake tip 4. Similarly, the fourth set of barbs 9 is offset from the second set of barbs 7 towards the stake tip 4. Alternatively, the first set of barbs 6 and the second set of barbs 7 may be offset towards the stake tip 4.

Figure 4:
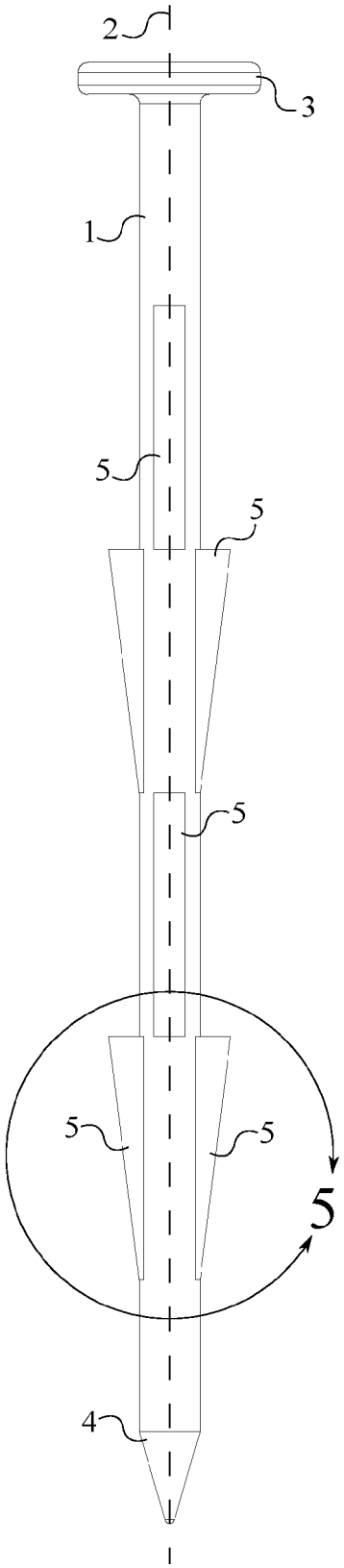
FIG. 4 is a left view of the present invention.
Figure 5:
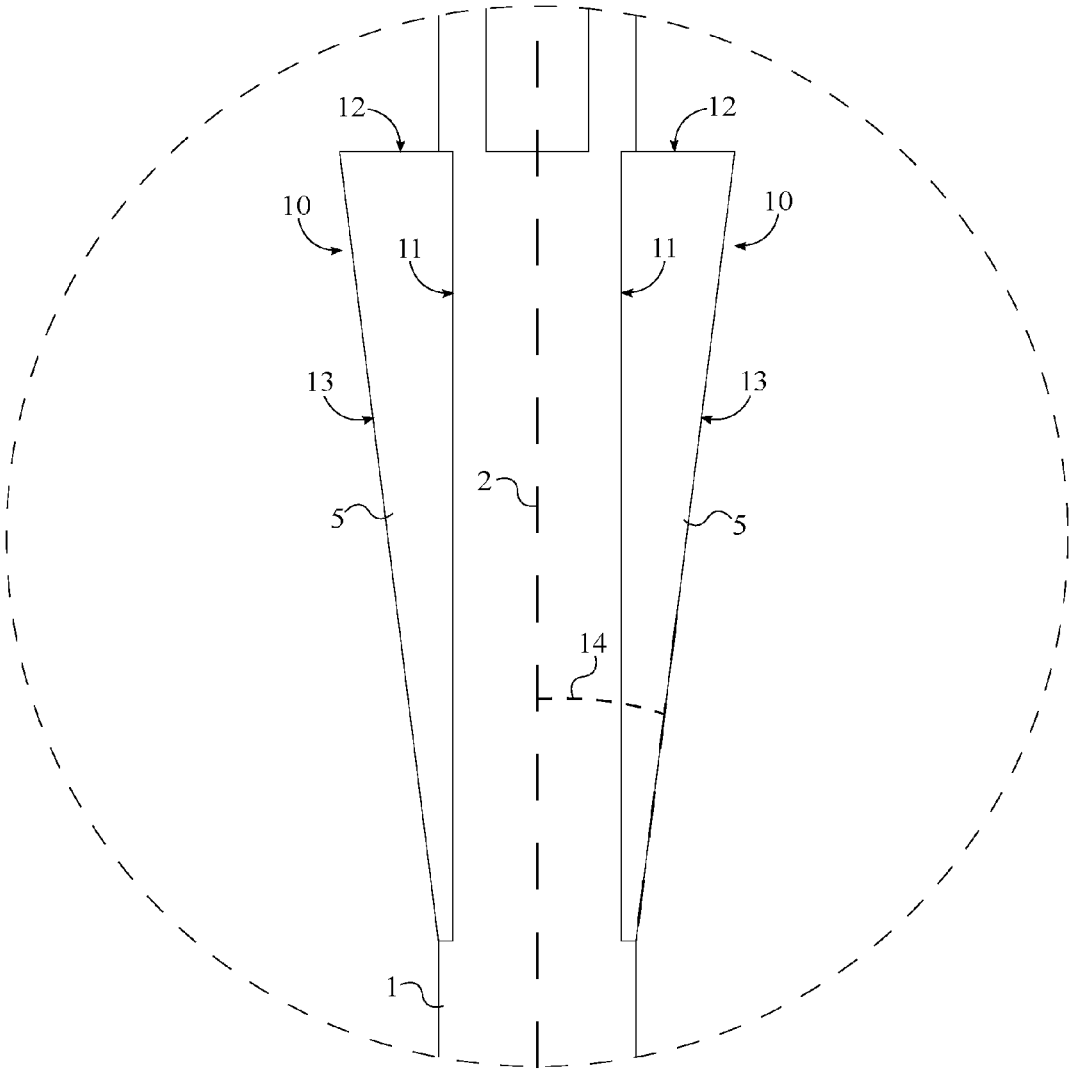
FIG. 5 is a left detailed view taken about the circle 5 in FIG. 4.

In reference to FIGS. 4-5, each of the plurality of barbs 5 forms a right-triangular profile 10. The right-triangular profile 10 comprises a base wall 11, a height wall 12, and a hypotenuse wall 13. The base wall 11 is laterally connected to the stake body 1. The height wall 12 is connected perpendicular to the base wall 11. The hypotenuse wall 13 is connected in between the base wall 11 and the height wall 12. In this arrangement, when the stake is being driven into a surface, the hypotenuse wall 13 displaces the material of the surface. The height wall 12 is positioned adjacent to the head 3 such that the height wall 12 snags or grips the material within the surface, preventing the barbed stake from becoming dislodged. The hypotenuse wall 13 is oriented at an acute angle 14 with a central axis 2 of the stake body 1. This is done to limit how much each of the plurality of barbs 5 resists being driven into a surface.

In the preferred embodiment of the present invention, the head 3, the stake tip 4, the stake body 1, and the plurality of barbs 5 are all made from polycarbonate. Polycarbonate is used because it is a rigid and durable material which can withstand hash conditions and rough use. Aside from polycarbonate, various other materials including, but not limited to, polyvinyl chloride (PVC), aluminum, steel, and high-density polyethylene (HDPE) may alternatively be used.

Although the invention has been explained in relation to its preferred embodiment, it is to be understood that many other possible modifications and variations can be made without departing from the spirit and scope of the invention as hereinafter claimed.

What is claimed is:

1. A barbed stake comprising:

a stake body;

a head;

a stake tip;

a plurality of barbs;

the head and the stake tip being concentrically connected to the stake body;

the head and the stake tip being positioned opposite to each other along the stake body;

the plurality of barbs comprising a first set of barbs, a second set of barbs, a third set of barbs and a fourth set of barbs;

the first set of barbs, the second set of barbs, the third set of barbs and the fourth set of barbs being connected to the stake body;

the first set of barbs, the second set of barbs, the third set of barbs and the fourth set of barbs being linearly distributed along the stake body;

the first set of barbs, the second set of barbs, the third set of barbs and the fourth set of barbs being located in between the head and the stake tip;

the first set of barbs and the second set of barbs being diametrically opposed to each other about the stake body;

the third set of barbs and the fourth set of barbs being diametrically opposed to each other about the stake body;

the third set of barbs being radially offset from the first set of barbs and the second set of barbs by 90 degrees;

the fourth set of barbs being radially offset from the first set of barbs and the second set of barbs by 90 degrees;

the third set of barbs being offset from the first set of barbs and the second set of barbs along the stake body;

the fourth set of barbs being offset from the first set of barbs and the second set of barbs along the stake body;

the third set of barbs being offset from the first set of barbs and the second set of barbs towards the stake tip;

the fourth set of barbs being offset from the first set of barbs and the second set of barbs towards the stake tip;

wherein uppermost barbs of the third and fourth sets of barbs are positioned above lowermost barbs of the first and second sets of barbs; and the head, the stake tip, the stake body, and the plurality of barbs being made from aluminum.

2. The barbed stake as claimed in claim 1 comprising:

each of the plurality of barbs forming a right-triangular profile;

the right-triangular profile comprising a base wall, a height wall and a hypotenuse wall;

the base wall being parallelly connected to the stake body;

the height wall being perpendicularly connected to the base wall; and the hypotenuse wall being connected in between the base wall and the height wall.

3. The barbed stake as claimed in claim 2 comprising:

the height wall being positioned adjacent to the head.

4. The barbed stake as claimed in claim 2 comprising:

the hypotenuse wall being oriented at an acute angle with a central axis of the stake body.

5. The barbed stake as claimed in claim 1 comprising:

the head being a discus; and the stake body being connected normal to the head.

* * * * *